US006235167B1

(12) United States Patent
Stauffer

(10) Patent No.: US 6,235,167 B1
(45) Date of Patent: May 22, 2001

(54) ELECTROLYZER FOR THE PRODUCTION OF SODIUM CHLORATE

(76) Inventor: John E. Stauffer, 6 Pecksland Rd., Greenwich, CT (US) 06831

( * ) Notice: Subject to any disclaimer, the term of this patent is extended or adjusted under 35 U.S.C. 154(b) by 0 days.

(21) Appl. No.: 09/459,007

(22) Filed: Dec. 10, 1999

(51) Int. Cl.[7] ..... C25B 9/00
(52) U.S. Cl. ..... 204/274; 204/275.1; 204/242
(58) Field of Search ..... 204/242, 275.1, 204/274, 280, 284; 205/503, 505

(56) References Cited

U.S. PATENT DOCUMENTS

| | | | | |
|---|---|---|---|---|
| 5,074,975 | * | 12/1991 | Oloman et al. | 205/503 |
| 5,242,554 | * | 9/1993 | Kagzur et al. | 205/503 |
| 5,419,818 | * | 5/1995 | Wanngard | 205/503 |
| 5,487,881 | * | 1/1996 | Falgen et al. | 205/503 |
| 5,965,004 | * | 10/1999 | Cowley et al. | 205/503 |
| 6,010,604 | * | 1/2000 | Stauffer | 204/242 |

OTHER PUBLICATIONS

Encyclopedia Technology Kirk–Athmereditors, 3rd Ed., vol. 5, pp. 633–645.

* cited by examiner

*Primary Examiner*—Bruce F. Bell
(74) *Attorney, Agent, or Firm*—Young & Basile

(57) ABSTRACT

An electrolyzer for the production of sodium chlorate ($NaClO_3$) from brine, the electrolyzer having four basic components: an electrolysis cell, a reactor, a heat exchanger, and a means for circulating the brine in a loop from the electrolysis cell, to the reactor, the heat exchanger, and back to the electrolysis cell, the electrolysis cell comprising electrically conductive pieces and non-conductive pieces with such pieces being randomly intermixed and spaced between two electrical contacts located in a cavity, the proportion of conductive to non-conductive pieces being sufficient to form strands or clumps of conductive pieces but less than the ratio which causes an electrical shunt between the electrical contacts.

3 Claims, 1 Drawing Sheet

ELECTROLYZER FOR THE PRODUCTION OF SODIUM CHLORATE

FIELD OF THE INVENTION

A new improved electrolysis cell has been developed for the production of sodium chlorate from brine. The cell comprises electrically conductive pieces and non-conductive pieces which are randomly mixed. The proportion of conductive to non-conductive pieces is sufficient to form strands or clumps of conductive pieces which function as electrodes.

STATE OF THE ART

The manufacture of sodium chlorate by the electrolysis of brine dates back to the year 1866 when the first commercial plant was completed in France. Since that time, numerous improvements have been made to the process although the basic chemistry has remained unchanged. An excellent review of the prior art is provided by the Encyclopedia of Chemical Technology, Kirk-Othmer editors, 3rd ed., Volume 5, pages 633–645. This material is included herein by reference in its entirety.

The challenge to making any advances in the production of sodium chlorate usually is reduced to finding means of improving the energy efficiency of the process. The significance of this effort is indicated by the fact that energy accounts for roughly 45 to 50 percent of the manufacturing cost. Moreover, in excess of 95 percent of the energy consumed can be traced back to the electrolysis step.

Given these requirements, the design of the electrolysis cell can be seen to be crucial. In fact, one of the most significant advances in recent years was the introduction of dimensionally stable anodes (DSA). These electrodes improved both current efficiency and energy consumption, however, they were more expensive to fabricate than the graphite anodes which were replaced.

Any future improvements in the production of sodium chlorate must balance the operating costs and the capital investment. Ideally, such an improvement should achieve savings in both of these areas. Therefore, it is an object of the present invention to provide for an improved electrolysis cell that will reduce energy consumption and at the same time minimize investment cost.

These and other objects, features and advantages of the invention will be apparent from the accompanying drawing and the following description.

SUMMARY OF THE INVENTION

Figure 1:
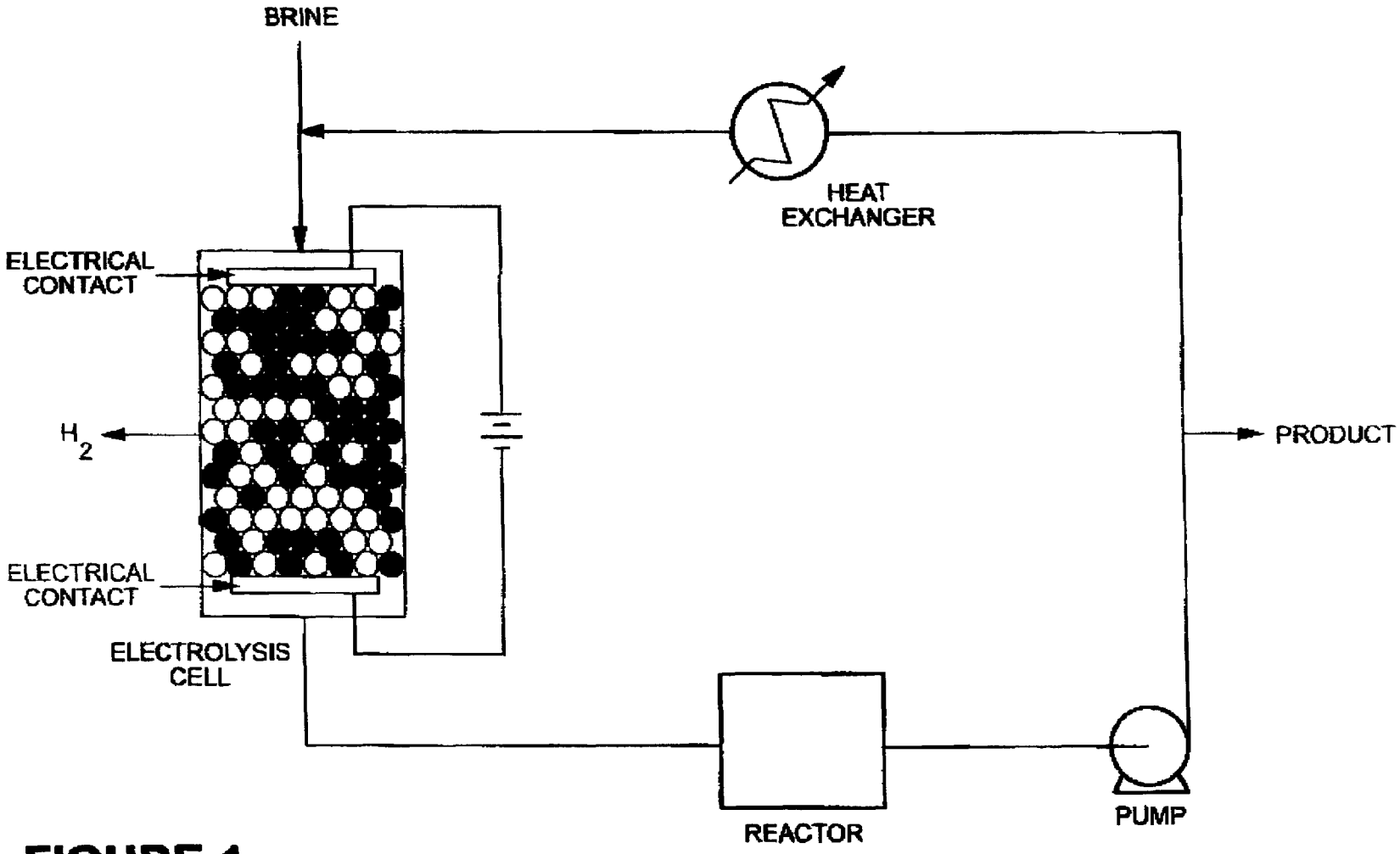
FIG. 1 is a schematic diagram of the electrolyzer designed for the production of sodium chlorate from brine. The electrolyzer comprises an electrolysis cell with random packing of conductive (shaded) and non-conductive (white) spheres, a reactor, pump, and heat exchanger.

In a preferred embodiment, the present invention discloses a novel electrolyzer for the production of sodium chlorate from brine. This electrolyzer has four basic components: an electrolysis cell, a reactor or reaction zone, a heat exchanger, and a means for circulating the brine in a loop from the electrolysis cell to the reaction zone, the heat exchanger, and back to the electrolysis cell.

The design of the electrolysis cell is unique. It comprises electrically conductive pieces and non-conductive pieces, which are randomly intermixed. These pieces are spaced between two electrical contacts or leads and contained in a suitable cavity through which the brine is circulated. The proportion of conductive pieces to non-conductive pieces is sufficient to form strands or clumps of conductive pieces. The proportion, however, is less than the ratio which would cause an electrical shunt across the electrical contacts.

The apparatus is designed so that as brine flows through the electrolysis cell, hypochlorous acid is formed by an electrical current passing through the bed of particles. This hypochlorous acid is slowly converted to chlorate in the reaction zone. Excess heat given off by the reaction is removed in the heat exchanger. A product stream is withdrawn from the loop, and makeup brine is added. Hydrogen gas produced by the electrolytic reaction is vented from the electrolysis cell. Sodium chlorate is recovered from the product stream in equipment that is not part of this invention.

DETAILED DESCRIPTION OF THE PREFERRED EMBODIMENT

A knowledge of the chemistry related to the production of sodium chlorate is necessary to understand the features of the present invention. When an electric current is passed through a brine solution containing sodium chloride and water, the following reactions take place.

At the anode:

$$2Cl^- \rightarrow Cl_2 + 2e^-$$

$$Cl_2 + H_2O \leftrightarrows HOCl + HCl$$

At the cathode:

$$2H^+ + 2e^- \rightarrow H_2$$

In the bulk of the solution:

$$HOCl \leftrightarrows ClO^- + H^+$$

$$2HOCl + ClO^- \rightarrow ClO_3^- + 2Cl^- + 2H^+$$

Side reaction at the anode:

$$6ClO^- + 3H_2O \rightarrow 2ClO_3^- + 4Cl^- + 1.5O_2 + 6H^+ + 6e^-$$

The above chemical equations indicate that chlorine is formed at the anode and reacts with water to give hypochlorous acid. Some of the hypochlorous acid dissociates to form hypochlorite ions. In the bulk of the solution, hypochlorous acid and hypo chlorite ions slowly combine to produce chlorate ions. A competing reaction, however, can occur at the anode. Through a side reaction, hypochlorite ions can be oxidized to chlorate.

In order to achieve 100 percent current efficiency in the process, the side reaction, namely the formation of chlorate at the anode, must be completely suppressed. If, on the other hand, all the chlorate is formed by the oxidation of hypochlorite at the anode, the maximum current efficiency is only 66.7 percent.

Given the above reaction conditions, the electrolysis cell should be designed so that the brine solution is quickly removed from the electrolysis cell to a reaction zone where the slower chlorate formation can take place. This requirement can be met by designing the electrolysis cell to have a maximum electrode surface relative to its retention volume.

The present invention is uniquely capable of maximizing the area of the electrodes relative to the void space of the electrolysis cell. This ratio of surface area to volume can be increased simply by decreasing the size of the pieces which form the electrolytic bed. The electrolytic bed is composed of electrically conductive and non-conductive pieces randomly mixed together and spaced between two electrical contacts. The proportion of conductive to non-conductive particles is sufficient to form strands or clumps of conductive particles which function as electrodes. Thus, one or more strings of conductive particles extend out from one of the electrical contacts. Likewise, other strings stretch out from the second electrical contact. To prevent an electrical shunt between the electrical contacts, the proportion of conductive to non-conductive particles cannot exceed a certain limit. This limit will depend on the cell geometry.

There is a restriction on the smallest size of pieces or particles that can be used in the electrolytic bed. With pieces that are too little, the resistance to the flow of the brine through the electrolysis cell will be excessive. This resistance to flow, however, can be reduced by using spherically shaped pieces.

FIG. 1 illustrates an electrolysis cell comprising conductive spheres (shaded) and non-conductive spheres (white). A key attribute of the cell is the randomness of the packing. Both conductive and non-conductive spheres form clumps or strands that are inter-tangled. The shaded strands stand out, appearing to be not unlike a neural network with each shaded body or neuron in contact with adjacent shaded ones. Carrying this analogy one step further, electrical impulses or signals are passed along these strands. The intimacy between shaded and white strands makes for a highly interactive network. This pattern is ideally suited for electrolysis by offering minimum electrical resistance.

The development of dimensionally stable anodes (DSA) is advantageous to the present invention. These electrodes exhibit very low corrosion rates so that pieces fabricated from these materials will maintain their integrity. So-called DSA are commonly fabricated from a base metal such as titanium or niobium, which is coated with a noble metal or noble metal oxide. Thus, platinized titanium spheres would be suitable for the conductive pieces. Although DSA are preferred, the present invention need not be restricted to their use. Such traditional anode materials as graphite and lead oxide are possible.

The non-conductive pieces can be fabricated from an assortment of materials including plastics, ceramics and glass. These materials should be corrosion resistant, durable, and inexpensive. In order to assist the intermixing of the conductive and non-conductive pieces, it is preferable that these two components have similar densities. The specific gravity of corundum, aluminum oxide, is 4.0 which is not significantly different from the specific gravity of titanium, namely, 4.5.

Much of the discussion about materials of construction is also applicable to the design of the electrical contacts, the walls of the electrolysis cell, the reaction vessel, the pump, and the heat exchanger. Additionally, knowledge gained from the operation of existing sodium chlorate processes can be applied to these problems.

The advantages of the present invention can best be demonstrated by the examples which follow. Examples 1 and 2 illustrate the prior art, which is based on the use of parallel plates as electrodes. As indicated by Example 3 and 4, which incorporates the improvements of the present invention, the ratios of electrode surface to cell void space are substantially greater than those provided by the prior art. These results assure that the holdup time for brine in the electrolysis cell will be substantially less with the proposed improvements.

Furthermore, the simplicity of the design of the present invention all but guarantees that the investment costs will be similar or even lower than that needed for existing technology. The importance of these results cannot be overestimated. Sodium chlorate is the second largest volume of chemical, after chlorine/caustic soda, that is produced by electrolysis. Any improvement in its economics will have a significant impact on its utility.

EXAMPLE 1

Electrodes are parallel plates spaced 0.6 cm apart. The anode is fabricated from graphite.

basis: plates=100 cm×100 cm electrode area=20,000 $cm^2$ cell void volume=6,000 $cm^3$ ratio area to volume=3.34 $cm^{-1}$

EXAMPLE 2

Electrodes are parallel plates spaced 0.3 cm apart. The anode is fabricated from platinized titanium.

basis: plates=100 cm×100 cm electrode area=20,000 $cm^2$ cell void volume=3,000 $cm^3$ ratio area to volume=6.67 $cm^{-1}$

EXAMPLE 3

Electrodes are comprised of coated titanium spheres 0.3 cm diameter, randomly mixed with insulating spheres of the same diameter in the ratio of 1:1. The spheres are packed in a simple cubic lattice.

basis: cell vol.=1000 $cm^3$ volume of all spheres=520 $cm^3$ cell void volume=480 $cm^3$ area of titanium spheres=5,200 $cm^2$ ratio area to volume=10.83 $cm^{-1}$

EXAMPLE 4

Electrodes are comprised of coated titanium spheres 0.2 cm diameter, randomly mixed with insulating spheres of the same diameter in the ratio of 1:1. The spheres are packed in a face-centered cubic lattice.

basis: cell vol.=1000 $cm^3$ volume of all spheres=740 $cm^3$ cell void volume=260 $cm^3$ area of titanium spheres=11,100 $cm^2$ ratio area to volume=42.69 $cm^{-1}$

What is claimed is:

1. An electrolyzer for the production of sodium chlorate from brine, said electrolyzer having four basic components: an electrolysis cell, a reaction zone, a heat exchanger, and a means for circulating the brine in a loop from the electrolysis cell to the reaction zone, the heat exchanger, and back to the electrolysis cell, said electrolysis cell comprising electrically conductive pieces and non-conductive pieces with such pieces being randomly intermixed and spaced between two electrical contacts located in a cavity, the proportion of conductive to non-conductive pieces being sufficient to form strands or clumps of conductive pieces but less than the ratio which causes an electrical shunt between the electrical contacts.

2. An electrolyzer according to claim 1 where the conductive pieces are platinized titanium spheres.

3. An electrolyzer according to claim 1 where the non-conductive pieces are corundum spheres.

* * * * *